United States Patent [19]

Spengler

[11] Patent Number: 4,940,150

[45] Date of Patent: Jul. 10, 1990

[54] MODULAR STORAGE RACK

[75] Inventor: William E. Spengler, Perrysburg, Ohio

[73] Assignee: Tolco Corporation, Toledo, Ohio

[21] Appl. No.: 380,012

[22] Filed: Jul. 14, 1989

[51] Int. Cl.[5] ..... A47B 47/00

[52] U.S. Cl. ..... 211/188; 211/133; 211/194

[58] Field of Search ..... 211/188, 194, 133, 186

[56] References Cited

U.S. PATENT DOCUMENTS

| | | | |
|---|---|---|---|
| 4,467,927 | 8/1984 | Nathan | 211/188 |
| 4,620,637 | 11/1986 | Karashima | 211/188 |
| 4,628,625 | 12/1986 | Hepp | 211/194 X |

*Primary Examiner*—Alvin C. Chin-Shue
*Assistant Examiner*—Sarah A. Lechok
*Attorney, Agent, or Firm*—Emch, Schaffer, Schaub & Porcello Co.

[57] ABSTRACT

A modular storage rack is disclosed which is constructed of a plastic resin and will not corrode or rust. The storage rack is easily assembled and disassembled as it uses only a friction fit to retain the structural elements in position.

4 Claims, 3 Drawing Sheets

MODULAR STORAGE RACK

BACKGROUND OF THE INVENTION

The present invention relates to a modular, lightweight, non-corrosive, easy to construct storage rack or shelving unit. The storage rack is designed to be used for the storage of corrosive products such as liquid chemicals. The storage of such products inherently demands a shelving unit which is structurally strong, and not affected by the corrosive action of the stored products. Further, the shelving unit should provide easy access to the products stored. Further, it is desirable that the storage rack be lightweight and easy to assemble and disassemble for the purposes of cleaning the storage site. In the past, various combinations of metal shelving have been used for such storage and have been found to be unsatisfactory in providing the safe, clean chemical storage desired.

SUMMARY OF THE INVENTION

The present invention provides a sleek, modular shelving unit which is constructed of a plastic resin and will not corrode or rust. The storage rack is designed to provide easy access to the products being stored and allows those products to be dispensed from their position of storage. The storage rack is lightweight, strong and safe and can be easily constructed and disassembled to provide for ease of cleaning. The storage rack comes in a plurality of stacked modules which may be assembled or disassembled to provide any height or structure desired for the product storage.

DETAILED DESCRIPTION OF THE PREFERRED EMBODIMENT

Figure 1:
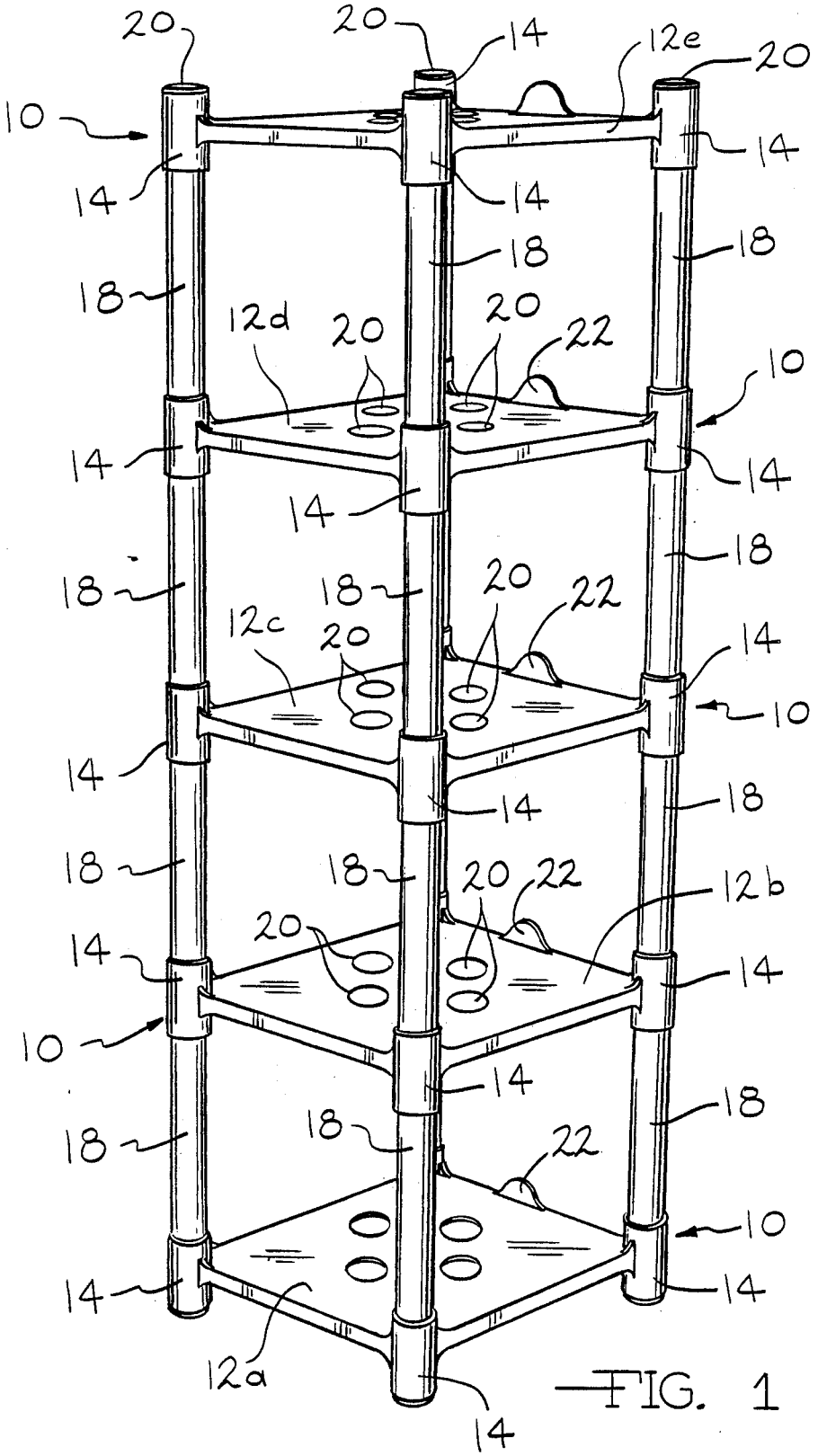
FIG. 1 is a perspective view of the storage rack of the present invention.
Figure 2:
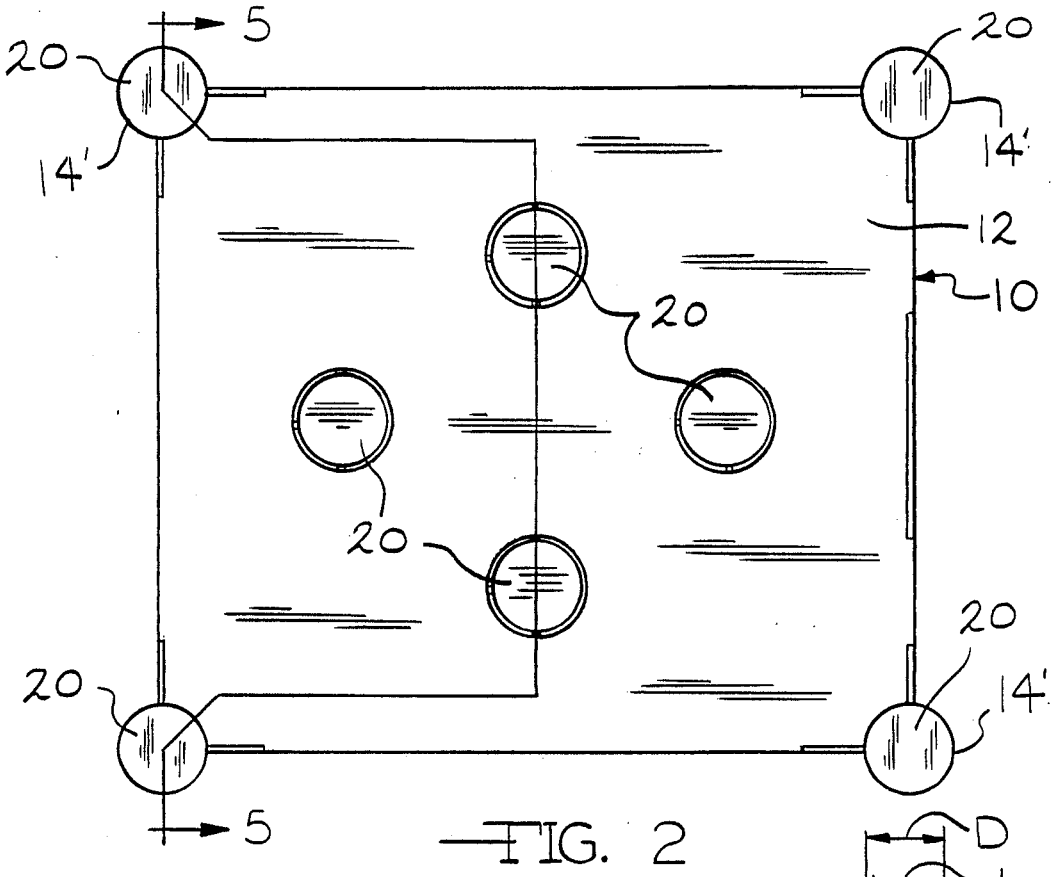
FIG. 2 is a top view of a shelving member of the storage rack of the present invention.
Figure 3:
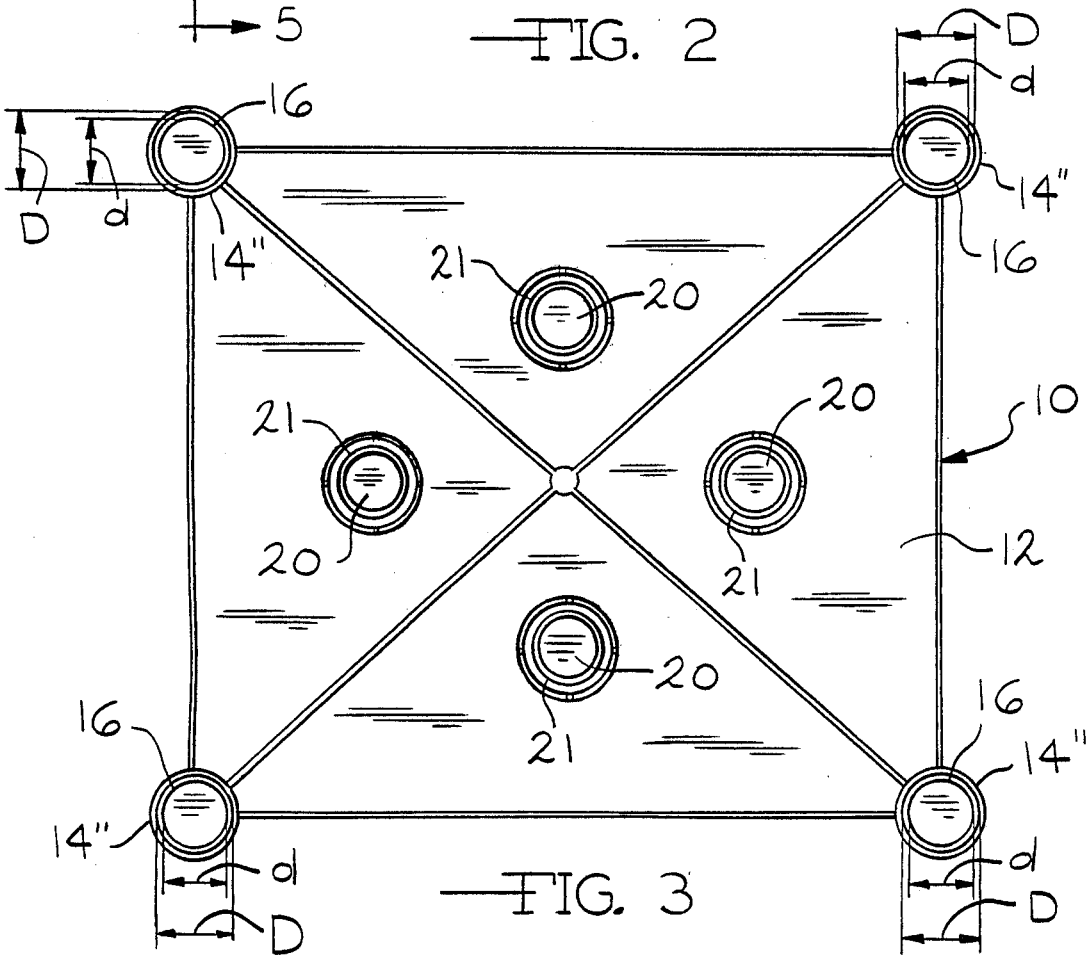
FIG. 3 is a bottom view of the shelving member of FIG. 2.

The present invention provides a modular dispensing rack or storage rack which can be used to organize corrosive product storage, such as liquid chemicals. The storage rack is unique in that it provides a modular set of shelves which can be constructed to provide shelving units of any height or size. These shelving units are specifically designed to provide a safe, sturdy foundation upon which to rest product dispensing members having dispensing faucets.

The preferred embodiment of the present invention provides for a plurality of shelving members 10 constructed of a plastic resin such as, but not limited to, polypropylene. The shelving members 10 include a generally square shelf unit 12 having leg receptors 14 positioned in the four corners of the shelf unit 12. The leg receptors 14 are hollow, defining an upper receptor 14' and a lower receptor 14", and have a specified interior diameter D. Located at the mid way point of each leg receptor 14 is a stop ring 16 of smaller diameter d. A solid membrane or webbing 24 extends across the space defined within the smaller diameter d of the stop ring 16 and separates the upper receptor 14' from the lower receptor 14".

The present invention further provides tubular legs 18 having an outside diameter D' designed to mate with the interior diameter D of the leg receptors 14. The mating tolerance between D and D' is provided close enough to create a friction fit assembly when the legs 18 are inserted into the leg receptors 14. During assembly the legs 18 slide through the interior diameter D of the leg receptor 14 until engagement with the stop ring 16. The shelf units 12 are stacked in a vertical orientation by placing legs 18 in each of the upper leg receptors 14' of a first shelf unit **12*a*. A second shelf unit 12*b* is then placed upon the four upright legs 18 by inserting those legs 18 into the lower leg receptors 14" of the second shelf unit 12*b*. Another set of four legs 18 may then be placed in the upper leg receptors 14' of the second shelf unit 12*b* to receive and support a third shelf unit 12*c*, if desired. Thus, a storage rack of any desired height may be constructed. The legs 18 may be provided in various lengths to offer desired versatility in shelving heights. Also the tubular legs 18 may be extended above the uppermost shelf unit 12*e*, if desired, to facilitate the support of extraneous mechanical units or piping and the like. As a further alternative embodiment, the tubular legs 18 may be affixed to the lower leg receptors 14" of the first shelf unit 12*a* to raise the first shelf unit 12*a*** off the floor in a higher desired position. Such an embodiment will facilitate ease of cleaning and sanitation under the storage rack. There are no nuts, bolts, or screws for use in the construction of the storage rack of the present invention. Therefore, disassembly of the storage rack to facilitate cleaning of the storage area is facilitated.

Figure 4:
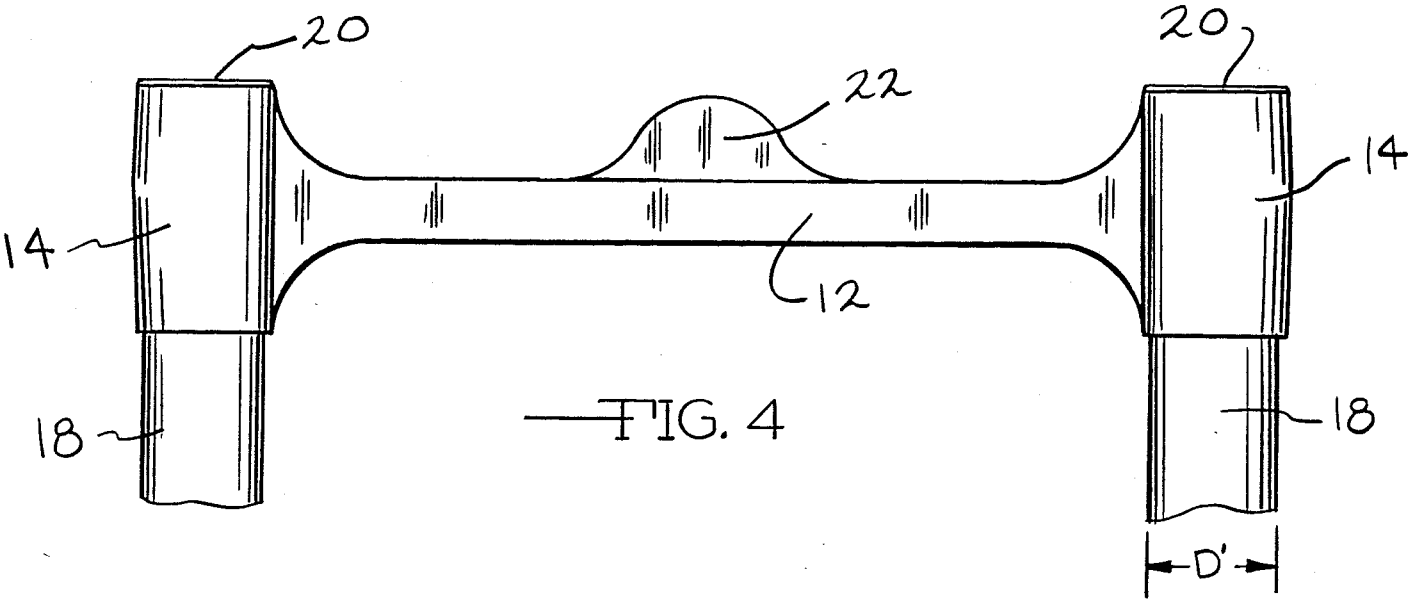
FIG. 4 is a side view of the shelving member of FIG. 2.
Figure 5:
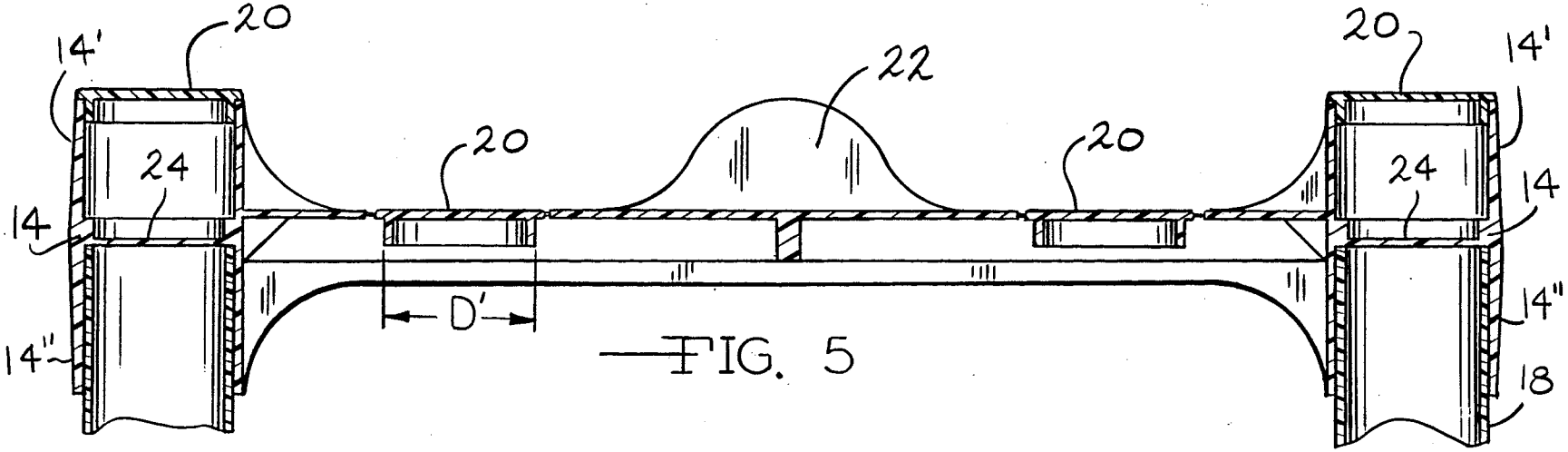
FIG. 5 is a cutaway view along line 5—5 of FIG. 2.

Each shelf unit 12 has a set of four knockout plugs 20 spaced throughout the shelf unit 12. The knockout plugs 20 are designed to be removed and inserted into any unused and therefore remaining open leg receptors 14 after construction of the storage rack is completed. The knockout plugs 20 have an outside diameter designed to provide an edge which, when in position, is flush with the outside diameter of the leg receptors 14. See FIGS. 4 and 5. The knockout plugs further include an inner ridge 21, the diameter of which is the same as the diameter D' of the legs 18, intended to provide a friction fit with the interior diameter D of the leg receptors 14 when the plug 20 is engaged with the leg receptors 14. It is preferable that the plugs 20 be placed in the leg receptors 14' of the uppermost shelf unit **12*e* to provide a finished look to the top of the rack. The plugs 20 are also preferably inserted into the leg receptors 14" of the lowermost shelf unit 12*a* to serve as a spacer between the floor and the shelf unit 12*a* thereby further assisting in providing for case of cleaning and sanitation of the storage area under the rack. The knockout plugs 20** provide a finished look to the modular storage rack when fully assembled.

A stop lip 22 is positioned at the back of each shelf unit 12 to facilitate the storage of product containers on the unit. The product containers are then pushed onto the shelf unit until they reach the stop lip 22. This prevents the product containers from being pushed off of the rear of the shelf unit 12 and further facilitates the positioning of the product containers within the shelf unit 12.

Other variations on the preferred embodiment may be envisioned after reviewing the drawings and this specification. However, this description of the preferred embodiment is intended to be solely illustrative and is not intended to be limiting upon the scope and content of the following claims.

I claim:

1. A rack for storing items comprising in combination: a shelf member having pairs of opposed leg receptors positioned in spaced relationship about the perimeter of said shelf member, said shelf member having an upraised stop lip located proximate one edge for facilitation of positioning of such stored items on said shelf member; and leg members for mating with said receptors to extend in opposed directions from said shelf member, thereby providing for stacking of said shelf members to form a vertical rack with said leg members interspersed between said shelf members and wherein said shelf members include a plurality of knockout plugs in the surface of said shelf members, wherein said knockout plugs are removed from said shelf members and mated with any unused leg receptors thereby sealing any of said unused leg receptors.

2. The storage rack of claim 1, wherein said leg members mate with said leg receptors through a friction fit.

3. The storage rack of claim 1, further including a means for limiting the position in which items may be stored on said shelving units.

4. A storage rack comprising in combination:

a four-sided shelf member having opposed leg receptors positioned at each of the four corners of said shelf member;

leg members for mating with said leg receptors to extend in opposed directions from said shelf members thereby providing for stacking of said shelf members to form a vertical rack with said leg members interjoined between said shelf members, said leg members being designed to frictionally mate and lock with said receptors; and a plurality of knockout members spaced through such shelf member, wherein said knockout members removed from said shelf member and mated with any unused leg receptors thereby sealing said unused leg receptors.

* * * * *